United States Patent [19]

Runft et al.

[11] 3,936,977

[45] Feb. 10, 1976

[54] FLUID ACTIVATED LOAD OPERATOR

[75] Inventors: Arthur J. Runft, Mequon; Walter E. Meyer, Saukville, both of Wis.

[73] Assignee: Kelley Company, Inc., Milwaukee, Wis.

[22] Filed: Dec. 27, 1973

[21] Appl. No.: 428,924

[52] U.S. Cl. ..... 49/137; 49/138; 49/340; 49/363

[51] Int. Cl.[2] ..... E05F 15/02

[58] Field of Search ..... 49/26–28, 360, 49/363, 137, 138, 340; 91/24, 31, 407, 410

[56] References Cited

UNITED STATES PATENTS

| | | | |
|---|---|---|---|
| 2,489,911 | 11/1949 | Lifner | 91/24 X |
| 3,186,307 | 6/1965 | Ellenbogen | 91/31 |
| 3,276,164 | 10/1966 | Hilfing et al. | 49/28 |

*Primary Examiner*—Kenneth Downey

*Attorney, Agent, or Firm*—Andrus, Sceales, Starke & Sawall

[57] ABSTRACT

A door operator includes a double acting power cylinder with a dual metering valve mounted thereon. The valve unit includes an external tube with a sliding control piston coupled to the power cylinder for corresponding selected movement. A pair of spaced metering assemblies are secured to the tube and each includes a supply-exhaust port connected through a four-way valve means to an air supply and an exhaust, and connected to provide air flow to and from opposite end heads of the power cylinder. Each assembly has a one-way supply passageway, a central speed control passageway and a fixed damping passageway. The latter two passageways each have a small needle valve control and the speed control passageway is selectively blocked by the control piston.

The power and damping cylinder assembly includes a mounting enclosure with the controls therein and with the power cylinder piston rod pivotally connected to a tubular drive arm. An adjustable excursion rod adjustably telescopes into the drive arm and in turn is pivotally interconnected to a second positioning rod. A pivotal mounting bracket is adjustably secured to the outer end of the positioning rod for attachment to the door. The linkage adapts the operator to various sizes and types of doors, with a special positioning rod and angle drive arm provided for swinging doors.

A ratcheting relay control unit is coupled to control the solenoid valve in response to actuation of any one of a plurality of interconnecting control and/or safety switches.

20 Claims, 9 Drawing Figures

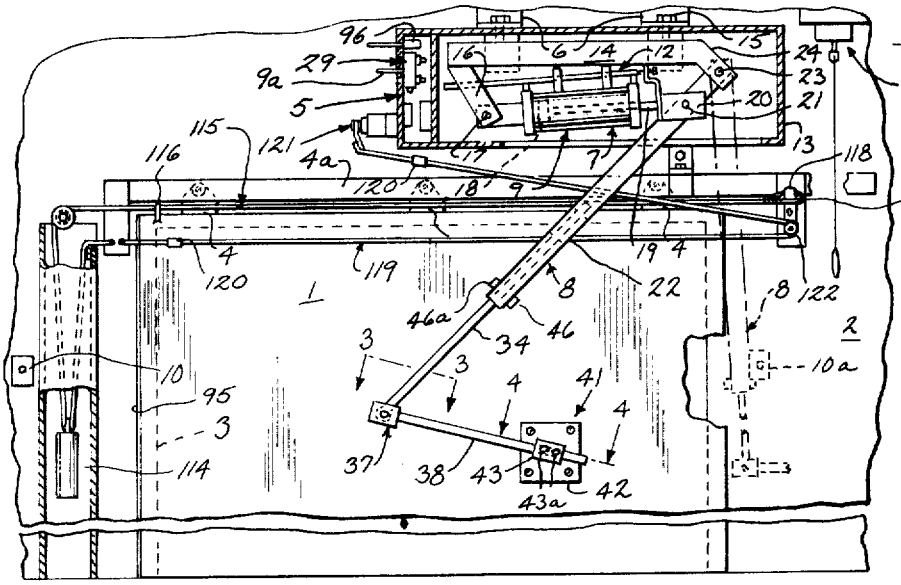
Fig. 1
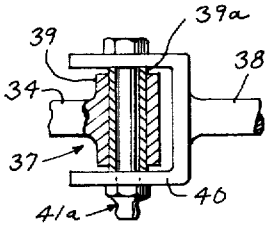
Fig. 3
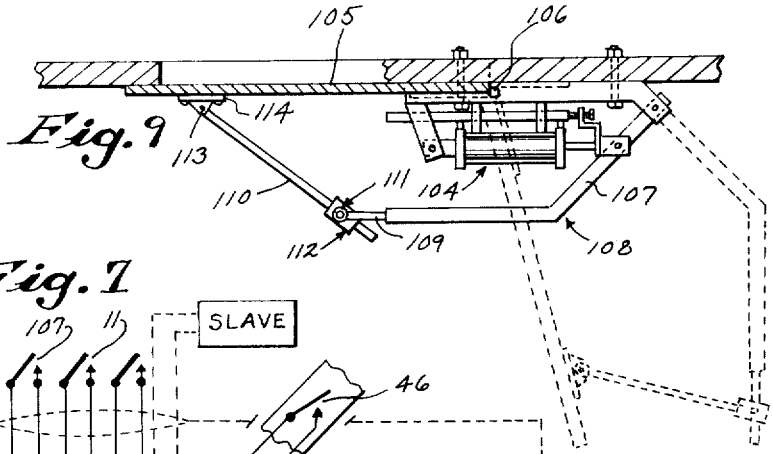
Fig. 9
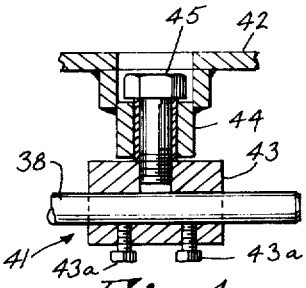
Fig. 4
Fig. 7
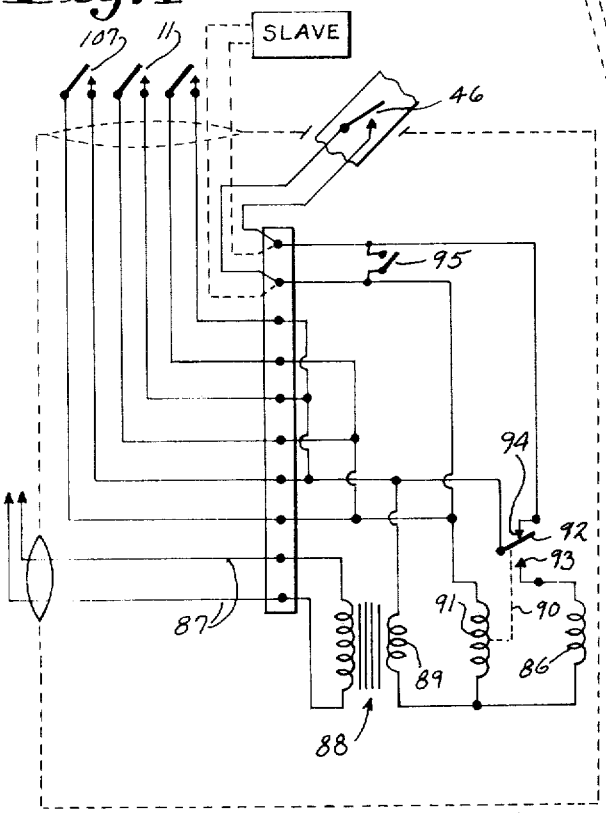
Fig. 8
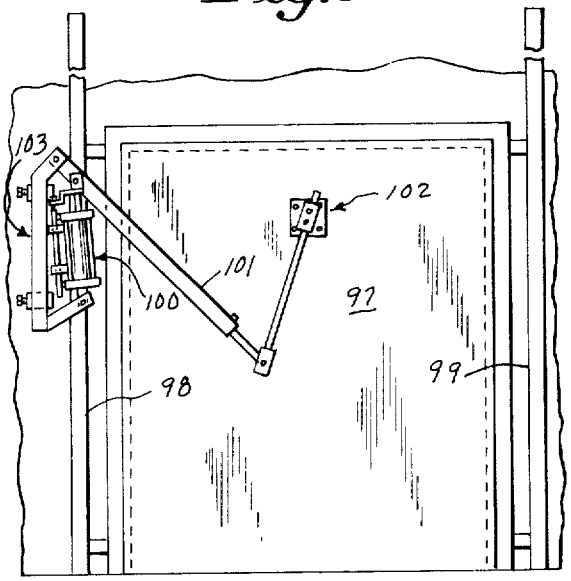

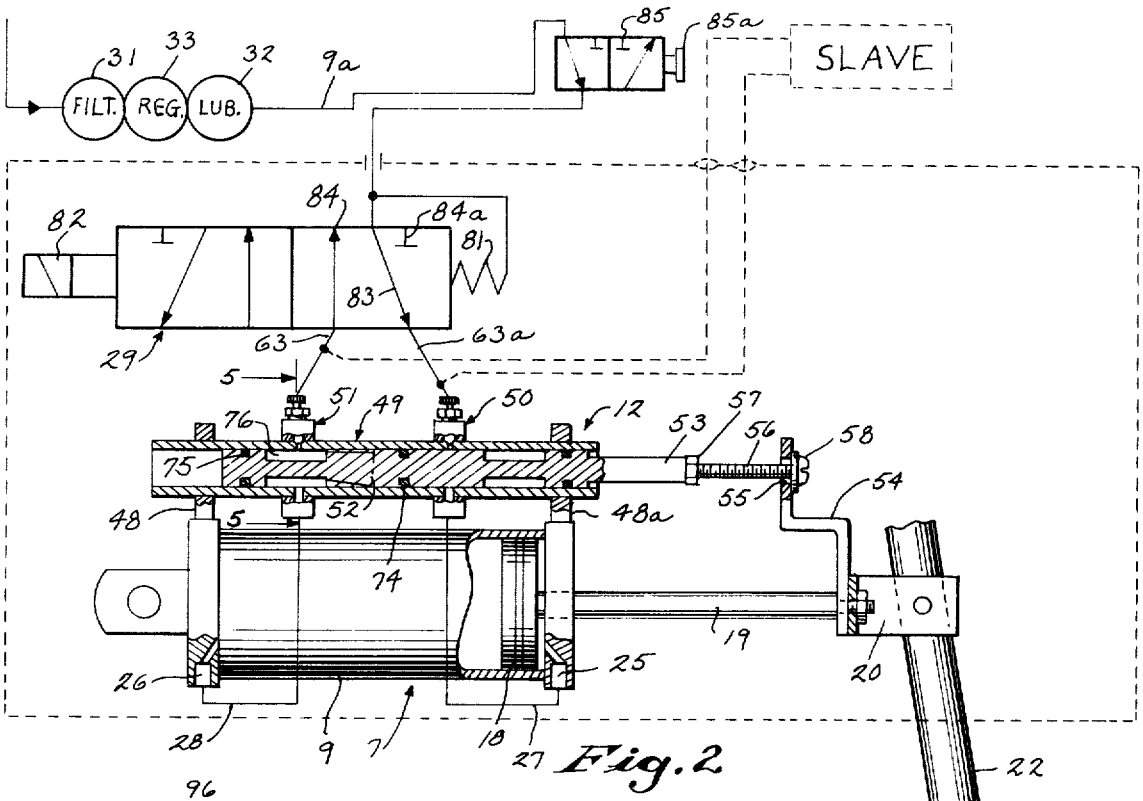
Fig. 2
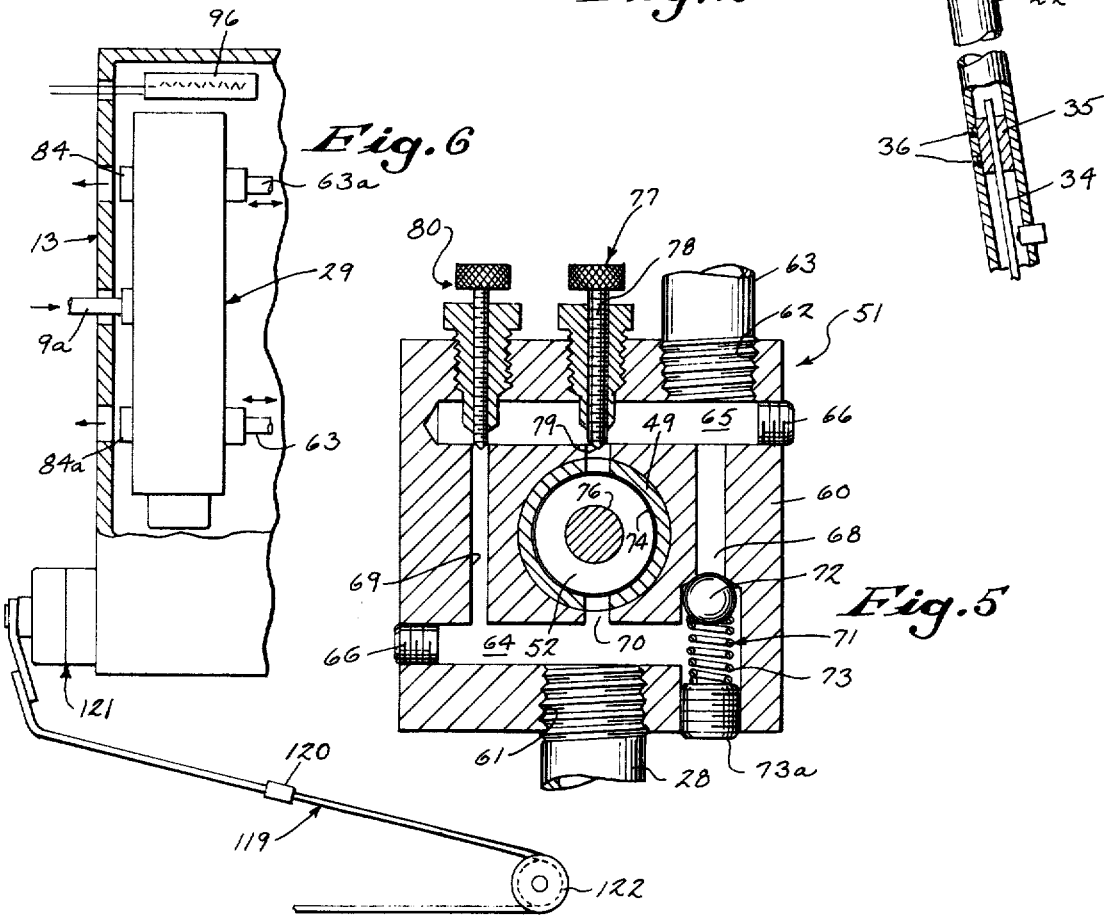
Fig. 6
Fig. 5

FLUID ACTIVATED LOAD OPERATOR

BACKGROUND OF THE INVENTION

This invention relates to fluid operating apparatus for positioning of load devices and in particular to a pneumatic operating apparatus having speed change control for moving relatively heavy loads, such as heavy duty industrial, commercial, and refrigerator doors and other closure members.

Fluid driven positioning apparatus is widely employed in industry for rapidly and reliably positioning of various types of loads, including valves, dampers, machine operating elements as well as various closure members. In the institutional and commercial field, automatic door closures may employ fluid driven operators for automatic closing and opening of the doors in response to an appropriate input signal. The operators may be either hydraulic or pneumatic operated. Pneumatic driven door operators may employ air supplies which are generally available in other parts of the institution or which can be readily supplied. Pneumatic systems also are highly desirable in connection with the convenient method of exhausting of the system to the atmosphere.

In such operators, and particularly in connection with door operators, the controlled movement of the door is extremely important to permit safe movement of personnel and associated equipment. Thus, the operator desirably provides relative rapid movement of the door without, however, creating dangerous conditions. This, of course, is particularly significant in heavy door installation such as encountered in industrial and commercial application. Thus, if an operator should be opening or closing a door and during the movement, a vehicle such as a forklift unit attempts to move through the opening without allowing adequate clearance, interengagement could cause severe damage to the door structure and/or the vehicle structure. The large mass of industrial and/or commercial door structure also requires that the velocity and deceleration of the door be controlled both during opening and closing to prevent possible damaging of the door mechanism.

Conventionally, pneumatic or fluid operators include controlled damping means built into the operator. For example, the conventional pneumatic cylinder will normally have the terminal portion of the piston stroke cushioned by a fluid volume of air within the terminal portion of the chamber and may be provided with a special damping chamber mechanism to permit control of the damping characteristic. Such conventional methods although operable do require relatively rugged special construction in order to compensate for the significant stresses and mechanical loads which may be encountered particularly when the piston rod directly interacts with the damping mechanism. Further, most operators are especially designed for particular applications and require relatively expensive custom installation. Although other forms of controls including metering means have been suggested, they have, for one reason or another, not found significant application and there is a great need for a rugged, reliable controlled door operator for providing controlled acceleration and deceleration of the door.

SUMMARY OF THE PRESENT INVENTION

The present invention is particularly directed to a fluid operator which can be readily applied to a door operator to provide a basic unit for controlling of various types and sizes of doors. Although the present invention can be employed in any desired automatic positioning control where control of velocity changes of the load positioning during the stopping and starting of the drive is considered important, the characteristic had been found to provide an exceptional satisfactory motor means for industrial and commercial door operators and is, therefore, particularly described in connection therewith.

Generally, the present invention includes a fluid motor means having a mechanical output coupled to position a load between various possible positions. The fluid motor means is coupled to a pressurized fluid supply which is preferably a pneumatic source through a novel metering control valve unit to permit selective control of velocity changes of the load in response to application of the fluid driving force. Generally, the metering valve of the present invention includes a control coupled to the actual load coupling and preferably directly to the mechanical output of the motor. The valve is thus positioned in accordance with the load position. The metering valve is coupled to the exhaust side of the motor means and particularly includes a plurality of parallel flow passages including a pair of two-way control passageways, at least one of which is selectively opened and closed in accordance with the movement of the door and the other of which provides an adjustable final damping characteristic. For reversible drive, the metering valve further includes a one-way passageway.

In accordance with a preferred and novel construction, the motor means is a reversible pneumatic motor having a pair of supply-exhaust means and having a metering valve unit constructed in accordance with the present invention connected to each of the supply-exhaust connections and to a pressure source. The one-way passageway is connected to permit pressure application via the metering valve to the motor drive means and with the two parallel passageway providing for a controlled exhaust. The movement of the motor drive means thus exhausts the fluid through the opposite metering valve with the one-way valve passageway being closed by the exhausting fluid while the other two control passageways provide for the controlled exhaust. When the load has been moved to a selected position the one exhaust passageway is fully or partially closed to thereby further modify the acceleration characteristic. The control passageways are formed with adjustable valve means such as needle valves to permit selective adjustment of the exhaust characteristic and thereby the acceleration and deceleration characteristic.

The present invention eliminates the undesirable heavy, mechanical loading associated with direct interaction between the operating piston and the damping mechanism as well as the undesirable mechanical coupling between auxiliary pneumatic or hydraulic damping cylinders mounting parallel to and mechanically coupled to the load cylinder. The latter exerts relatively heavy load bending moments on the piston rod with the resultant wear and reduced bushing life on the piston rod support.

In a preferred and particularly novel construction, the motor means includes a double acting power cylinder. The metering valve unit includes an external tube adapted to be mounted to the power cylinder with a control piston or spool slidably disposed therein. The piston rods of the power cylinder and valve unit are coupled for corresponding selected movement. A pair of spaced metering assemblies are secured to the tube which includes a supply-exhaust port connected through a four-way solenoid air valve means to an air supply and an exhaust. A first metering assembly is connected to one head of the power cylinder and the second assembly is connected to the opposite head of the power cylinder. Each assembly is similarly constructed with a one-way passageway between the two ports. A central passageway is formed through the valve body and the damping tube. The damping piston is specially formed to selectively open and close the passageway to provide a controlled exhaust flow. This passageway is preferably provided with a small needle valve to control the rate of flow therethrough and thereby permit adjustment of the acceleration of the power operator. Directly in parallel therewith is a second interconnecting exhaust passageway which further includes an adjustable needle valve. It provides a small continuous exhaust flow independent of the positioning of the damping piston and provides final controlled deceleration of the motor drive and load. Thus, the present invention provides complete control of the drive characteristics during both directions of a power drive by adjustable means controlling the exhaust flow from the fluid motor means. The particular characteristics during acceleration and deceleration are conveniently and independently controlled to produce a great variety of different characteristics by simple rearrangement or relative location and dimensions of the several components. Thus, a door may rapidly open for quick access while closing at a stepped rate of speed change to minimize the time. Maximum safety is provided by high final damping to the pinch point and the distance between the two metering valve assemblies relative to the piston units permits adjustment of the characteristic. The particular characteristic may be further produced, for example, by varying the clearance either in steps or progressively with the position relating to the valve assembly.

The adjustable control drive of the present invention is particularly desirable in application to door closures because it can be readily adapted to a great variety of different sizes and weights with widely varying hardware while maintaining the desired opening and closing characteristic.

In accordance with a further aspect and feature of the invention, a basic system includes an adaptive interconnecting mechanical linkages for coupling to horizontal and vertical sliding doors, swinging doors and overhead doors. The power and damping cylinder assembly as well as the electrical and air control means are housed within a mounting enclosure with the operating piston coupled to a pivotally mounted drive arm which projects outwardly of the housing. An adjustable excursion arm or link is connected to the drive arm and in turn is pivotally interconnected through a suitable adjustable coupling to a second positioning link or arm. A pivotal mounting bracket is adjustably secured to the outer end of the positioning arm for attachment to the door. The variable mechanical linkage permits the ready adaptation of the single power operator for various types of doors. Generally, for sliding doors the drive arm is a straight adjustable member interconnected at its outer end to the intermediate coupling. For a swinging door model, a special drive arm includes an offset portion to accommodate the swinging motion while minimizing the projection of the interconnecting mechanical linkage. Similarly the mounting bracket includes a pivot construction permitting the swinging motion. Each element is readily directly connected as a part of the linkage to the basic operator. For double door units of the sliding or swinging type, a main operator may be coupled to one door and a slave unit connected to the opposite door of the unit.

In accordance with a further novel feature of the present invention, the power cylinder and interconnected metering valve assemblies are mounted within a housing or enclosure along with the valving and electrical controls. The pivoted arm is secured to the power cylinder within the enclosure and projects outwardly therefrom. Environmental conditioning means may be provided to adapt the unitized construction to severe environmental conditions. Thus, heating and/or cooling means can be provided to maintain the operator components well within the necessary rated operating temperatures.

Although any desired control system can be employed, a very simple and reliable electrical control employs a ratcheting relay control to alternately set a switch contact between a closed door and an open door position to thereby set the circuit for opening and closing. Thus, it is only necessary to pulse the ratcheting relay to selectively energize the solenoid and thereby the supply of fluid power to the power operator. A plurality of interconnecting control switches are parallel connected to control the ratcheting relay. Further, one or more safety switches can similarly be parallel connected to control the relay and provide for desired reversing under any adverse or damaging conditions.

The present invention thus provides an improved fluidic motor drive with controlled acceleration and deceleration to thereby establish smooth, controlled characteristics of operation. By employing a pneumatic system the unit is readily adapted to existing building structures or commercial type structures and provides a relatively quiet continuously adjustable control or operator. Further, it can be readily constructed as an unitized integrated operator for adaptation to various control to new and existing door installations and the like. The simplicity and integrated construction is desirable from an initial cost, manufacture and installation, but also permits very convenient and subsequent maintenance by minimizing the number of parts for the various types of doors employed in industry and the ready access to such parts. The controlled movement and the ready interconnection of the safety controls further particularly adapts the door to a safe, reliable installation for protection of personnel and equipment.

BRIEF DESCRIPTION OF THE DRAWINGS

The drawings furnished herewith illustrate preferred constructions of the present invention in which the above advantages and features are clearly disclosed as well as others which will be readily understood from the subsequent description of such embodiments.

In the drawings:

FIG. 1 is a front elevational fragmentary view of a door operator applied to a horizontal sliding door unit forming a part of a building structure;

FIG. 2 is an enlarged elevational view of the power door operator system shown in FIG. 1 with parts broken away and sectioned to more clearly illustrate the details of construction;

FIG. 3 is a vertical section taken generally on line 3—3 of FIG. 1;

FIG. 4 is a fragmentary view taken generally on line 4—4 of FIG. 1;

FIG. 5 is an enlarged vertical section taken on line 5—5 of FIG. 2;

FIG. 6 is a fragmentary sectional view illustrating a preferred mounting of an air control valve shown in FIGS. 1–2;

FIG. 7 is a schematic illustration of a control circuit for application to the operator of FIGS. 1–6;

FIG. 8 is a view similar to FIG. 1 illustrating the application of the power operator of the present invention as shown in FIGS. 1–6 to a vertical rise door; and FIG. 9 is a view illustrating the same operator modified in accordance with the present invention for application to a swinging door.

DESCRIPTION OF THE ILLUSTRATED EMBODIMENTS

Referring to the drawing and particularly to FIG. 1, the present invention is shown applied to a sliding door 1 forming a part of a building structure 2 and overlying a door opening 3. The sliding door 1 in accordance with conventional practice is hung by a pair of spaced trolley units 4 from a suitable track structure 4*a*. An automatic power door opener or operator 5 constructed in accordance with the present invention is shown typically mounted immediately above the door track 4*a* by a pair of mounting brackets 6 secured to the building wall 2. Generally, the power operator of the present invention, illustrated in FIG. 1, includes a power pneumatic cylinder unit 7 coupled to the door through an adjustable driving linkage unit 8 which may be adapted to various sizes and types of doors. The mounting brackets 6 may be adjustably constructed to provide alignment of the linkage to the one surface of the door 1. The pneumatic cylinder 9 of unit 7 is coupled to a suitable air supply line 9*a* in response to any one of a plurality of control switch units of which one is shown at 10 in FIG. 1.

The pneumatic operator 5 may be driven from any suitable pneumatic supply such as the usual air supply employed in commercial establishments. The illustrated switch unit 10 is a push button type mounted adjacent to the door structure 1. Additionally, at least one similar unit 10*a* is provided on the opposite side and generally pull cord switch unit 11, which may be actuated by a forklift operator or the like as he approaches the door will also be provided to permit opening and closing of the door without leaving the forklift.

In accordance with the present invention, the air supply connection to the power cylinder 9 is controlled by a unique travel damping valve unit 12 mounted as a part of the power cylinder operator. The damping valve unit 12 establishes a controlled acceleration and deceleration of the door movement which permits setting of widely different opening and closing speeds. The damping valve in particular permits the matching of the operator characteristic to the door to permit smooth safe operation of the door. Generally, each actuation of a switch 10 actuates the operator from the previous actuation to reverse the door movement and thereby provide for the alternate opening and closing. Further, the door movement can be reversed during any portion of the door movement and, in fact, may be provided with automatic reversing safety switches to prevent damaging to protect personnel and equipment.

More particularly, in the illustrated embodiment of the invention, the door operator includes an outer enclosing shroud or housing 13 in the form of a generally rectangular box which is somethat larger than the power cylinder unit 7. The shroud 13 is secured to the wall by the mounting brackets 6. A generally L-shaped frame member 14 is secured or mounted to the mounting brackets 6 by suitable mounting bolts 15. The depending leg 16 of the frame 14 is bifurcated and the clevis of the power cylinder 9 is pivotally mounted to the lower end thereof as by a lubricated bolt 17. The usual piston 18 in the cylinder 9 is connected to a piston rod 19 and projecting outwardly from the front of the cylinder and coupled by a bifurcated clevis-bracket 20 and lubricated pin 21 to a drive arm 22 of the door connecting linkage 8. The upper end of the arm 22 is connected by a pivot attachment 23 to a small depending bracket 24 from the top leg of the mounting frame 14 and projects outwardly through an opening in housing 13 adjacent the surface of the door. The power cylinder unit 9 is thus mounted within the housing 13 in such a manner as to permit limited pivotal movement as the piston and rod 19 and interconnecting linkage 8 is moved to open and close the door 1.

As most clearly shown in FIG. 2, the combined inlet-outlet ports 25 and 26 are provided at the front and back heads of the cylinder 9 and connected respectively by inlet-outlet fluid lines 27 and 28 to the fluid supply and to exhaust by the unique damping valve 12 and a small four-way electrical solenoid air valve 29 which may be mounted within the shroud 13. The power cylinder unit 7 is a suitable double acting air cylinder providing extension and retraction of the piston rod 19 by appropriate supplying of air pressure to one end of the cylinder 9 while simultaneously exhausting the oppsoite end of the cylinder 9 through the special damping valve or meter unit 12. The air supply connection to the operator 5 will also include conventional air processing elements such as a filter 31 having an appropriate clean out to ensure a supply of clean dry air and a lubricating unit 32 to provide lubrication to the power cylinder. A pressure regulator 33 which usually includes a visual reading gauge will also normally be provided to permit a variable setting of the operating pressures. Thus, the introduction of air into the head port 25 causes retraction of the piston 18 while introduction of air into the rear head port 26 results in extension of the piston 18 with a corresponding positioning of the rod 19 and linkage 8, and particularly a pivoting of the drive arm 22 about its pivot point. The adjustable driving linkage 8 in the embodiment of the invention includes the arm 22 which is a suitable tubular member, and an adjustable excursion rod 34 which projects into the drive arm tube 22 and through an attachment plug 35 firmly affixed within the drive arm tube 22. A pair of set screws 36 secures rod 34, with the outermost end connected by a pivot joint unit 37 to a positioning rod 38. The projection of the excursion rod 34 is selected to establish the desired amplitude of movement or slide of the door. For small door installations, the free end of rod 38 is cut off so as not to interfere with the pivot mounting of the arm 22.

In the illustrated embodiment of the invention, the pivot joint unit 37 includes an eye member or hub 39 secured with its axis normal to that of the rod 34 to the outermost end of the excursion rod 34. An inner sleeve bearing 39*a* projects outwardly slightly of the hub to form end bearing surfaces. The excursion rod hub 39 is secured within a clevis 40 on the end of rod 38 by a grease bolt 41*a*. The positioning rod 38 projects outwardly and is adjustably secured to a mounting plate unit 41 having a mounting plate 42 which is bolted or otherwise firmly affixed to the door 1. A clamping block 43 slidably receives the positioning rod 38 which is firmly locked in place by set screws 43*a*.

The clamping block 43 is secured to the door pivot plate 42 by a pivotal joint including a stepped tubular journal 44 welded to the plates 42 in alignment with an access opening. A bolt 45 passes through a sleeve bearing inserted in the tubular journal 44 and is threaded into the block 43 and thereby provides a pivotal mounting of the clamping block 43 and rod 38 relative to the pivot plate 41 during the opening and closing movement of the door 1.

The multiple adjustable linkage and pivot joint coupling of the drive arm 22, excursion rod 34 and the positioning rod 38 permits adaptation of the operator 5 to a great variety of different sized horizontal sliding and vertical sliding doors as well as different door movements.

Excursion rod 34 is formed of a suitable flexible steel and flexes relative to the tube 22, particularly in the event an abnormal load is placed on the linkage 8 such as by an obstruction to the door movement. A small reversing safety switch 46 is mounted as by threading into a threaded opening in the tubular drive arm 22 in the path of rod 34 during the closing door movement. A similar switch 46*a* may be placed in the opposite side of arm 22 to respond during the opening of door 1. The reversing safety switch unit 46 and 46*a* are connected into the control circuit for the door operator 5 to automatically reverse the door movement in the event of an abnormal restraining force. The flexible rod 34 will, under all normal conditions, directly transfer the opening and closing forces to the door 1, with a minimum flexure which is insufficient to operate the switch. In the presence of any abnormal restraining load, however, the rod 34 will flex to activate the reversing safety switch or switches. The unique flexible linkage and safety switch assembly is more fully disclosed and claimed in Applicant' s copending application Ser. No. 428,923 entitled *Control Switching for Automatic Load Operators* filed Dec. 27, 1973 and assigned to the same assignee and is described herein to define a total integrated improved door operator.

The extension and retraction of the excursion rod 34 varies the effective length of the rod and, consequently, the arc at the outermost end of the rod 34, as shown by the phantom illustrated in FIG. 1, thereby controlling the linear movement or total travel of the door 1. Thus, in the initial setup with the shroud or housing 13 located, the rod 34 is slidably disposed within the plug 35 with the set screws 36 released and located with pivot joint 37 on the door center. The excursion rod 34 is then secured in place by tightening of the set screws 36. The door 1 is then opened and closed and the rod 34 projected outwardly to permit the door to completely open and close within its casement opening.

The precise movement between the desired door overlap limits is set by appropriate setting of the positioning rod 38. The location of the clamping block 43 and thus unit 41 closer to the pivot point unit 37 causes the entire door motion to move toward the opening side of the casement in the illustrated embodiment of the invention.

In practice, the unit 41 is appropriately located spaced vertically downwardly from the top of the door opening by 1/2 of the sum of distances between the top of the door opening and the positions of the joint 37 with the door closed and with the door opening. The horizontal position of unit 41 is adjusted upon the positioning rod to locate the same relative to the edge of the door opening equal to 0.1 of the door opening, with the door closed.

Once the proper adjustments of the excursion rod 34 and the positioning rod 38 have been made, the total assembly can be moved to the building and door proper. This may be advantageous where a number of basic similar doors are encountered having somewhat differing building appurtenances. Further, an installation may require relocation of the door operator by some subsequent building changes. With the operator of this invention, such changes are quickly and reliably made with a minimum of skill requirement.

In summary, the actual starting and stopping position of the door 1 is directly controlled by the position of the unit 41 on the position rod 38 with the length of movement controlled by the selective extension of the excursion rod 34. Thus, by appropriate energizing of the power cylinder, the door is moved between the opened and closed position. The total unit can be mounted with the positioning rod 38 pivoted to a mirror image with respect to joint 37. Various size tubular arms 22 may be provided to conveniently adapt the basic unit to different size openings and associated doors.

In accordance with a particularly unique aspect of the present invention, the door travel and particularly the acceleration and deceleration is controlled by the unique travel damping valve unit 12, which is most clearly shown in FIGS. 2 and 5. The travel, damping valve unit 12 is shown mounted to the cylinder 9 by a pair of mounted spaced brackets 48 and 48*a* on the top of the front and rear heads of the cylinder 9. The travel damping valve unit 12 particularly includes an outer tubular housing or tube 49 mounted in fixed relation by brackets 48 and 48*a* parallel to cylinder 9. A pair of air metering valve assemblies 50 and 51 are spaced axially of the cylinder or tube 49 and interconnected as a part thereof. The fluid lines 27 and 28 from the rear and front heads of the cylinder 9 are connected by air assemblies to common supply-exhaust lines from the four-way solenoid air valve 29. The air metering assemblies 50 and 51 are controlled by a common control spool or piston 52 which is slidably mounted in the tubular housing 49 to control assemblies 50 and 51. The damping piston 52 includes a control operator shown as an extending piston rod 53 projecting outwardly therefrom generally aligned with and in parallel to the power piston rod 19. A bracket 54 couples the power piston rod 19 to the damping valve rod 53 with a lost motion coupling to provide a predetermined interrelated movement of the damping piston 52 with the power piston 18. In the illustrated embodiment of the invention, the bracket 54 is secured to the bifurcated clevis 20 and is moved in accordance with the movement of the power piston rod and consequently directly in accordance with the position and movement of the door 1. The bracket 54 projects upwardly and includes an opening 55 through which a reduced threaded portion 56 extends. The damping valve rod 53 is provided with a pair of axially spaced shoulders which may be predesigned to provide predetermined fixed spaced relationship or as illustrated may be adjustably mounted on the piston rod. Thus, in the embodiment of the invention the damping valve rod is threaded and provided with a pair of spaced lock nuts 57 and 58 located to the opposite side of the upper end of the coupling bracket 55. The stroke and movement of the damping piston is controlled by appropriate positioning of the lock nuts 57-58 on the damping valve rod 56 with the spacing therebetween defining a lost motion coupling such that the power piston 18 in moving from a given position does not effect movement of the damping piston 52 during the initial accelerating portion of the door opening. During the terminal portion of the power cylinder movement and the door movement, the travel damping valve piston 52 is actuated to vary the characteristic of door movement. Further, as presently developed the traveling damping valve unit 12 functions to control exhaust of the air in cylinder 9 through the associated metering valve 50 and 51 to both control the acceleration and deceleration of the door operator 7 and interconnected door 1.

Each of the air metering assemblies 50 and 51 is similarly constructed and the air metering assembly 51 connected to the rear cylinder head is described in connection with the illustration of FIGS. 2 and 5. In the full illustration of FIG. 2, the piston rod 19 is fully extended to open the door 1 and thus is in the alternate position from that shown in FIG. 1. Air was previously applied to the rear head of the cylinder 9 and the piston 18 extended to the position of FIG. 2 by actuation of the four-way solenoid valve 29 with the air pressure maintained in cylinder 9 behind the piston 18. Actuation of valve 29 automatically reverses the connection and provides a supply of air through assembly 50 to the head port 25 with exhaust of the air in cylinder 9 through the rear port 26 and the metering valve assembly 51.

Thus, referring particularly to FIGS. 2 and 5, the air metering assembly 51 includes an outer body portion 60 which is secured in fluid tight engagement to the damping valve tube 49 and, in essence, to form an integral part of such tube. The illustrated body member 60 is generally a small rectangular blocklike member having parallel top and bottom walls. The bottom wall is provided with a tapped opening 61 for receiving the fluid line 28 from the rear head of the power cylinder 9. The top wall is provided with tapped opening 62 to one side, shown as the right side as viewed in FIG. 5, for receiving supply-exhaust line 63 from the four-way solenoid air valve 29. A pair of similar multiple passage coupling passageways 64 and 65 are formed extending laterally through the top and bottom portions of body 60 to the opposite sides of the damping valve tube 49 with the outer ends thereof closed by suitable threaded plugs 66. The lower passageway 64 projects laterally across the cylinder connecting opening 61 while the upper lateral passageway 65 extends laterally from the solenoid connection opening 63. The two lateral passageways 64 and 65 are connected by a plurality of interconnection of control passageways including a one-way supply passageway 68 to one side of tube 49, a closing damping passageway 69 to the opposite side of tube 49, and an intermediate speed adjusting passageway 70 which extends downwardly through the damping valve tube 49.

The supply passageway 68 as illustrated includes a one-way flow control means illustrated as a ball-check unit 71 which permits the free flow of air from the supply connection 62 to the power cylinder connection 61. The illustrated unit 71 includes a check-ball 72 urged by a spring 73 into closing engagement with a valve seat to the power cylinder connection side of the passageway 65. A plug member **73*a* closes the connection to the ball-check opening and stresses the ball spring to firmly hold the ball against the valve seat. When air is supplied from the solenoid valve 29 to the metering valve assembly 51, the air pressure positively forces the ball 72 downwardly and freely admits the passage of air to the cylinder connection 61 and via line 28 to port 26. However, when the solenoid valve 29 connects the solenoid connection 62 to exhaust the air from port 26, the opposite directional flow from the cylinder acts on the ball 72 to positively close this passageway 68 and diverts all exhausting air through the two alternate passageways 69 and 70**.

The speed adjusting passageway 70, as previously noted, extends through the travel damping valve tube 49 and piston 52 and is especially constructed to selectively control the air flow therethrough. The illustrated travel damping piston 52 is slidably mounted within the valve tube 49 and is generally of a corresponding size with a suitable sliding O-ring end seal 75 and a central seal 74 located to the opposite side of the metering valve assembly 51. The piston 52 further includes a reduced valving portion 76 which when aligned with the passageway 70 provides a minimal flow restriction therethrough with a corresponding coupling of passageway 64 to passageway 65 and thus from the power cylinder 9 to the exhaust-side of solenoid valve 29. The alignment of the portion 76 with the valve assembly 49 is controlled by the spacing of the stops 57 and 58. In the illustrated embodiment, adjustable stops 57 and 58 are shown. In practicing the invention, Applicant has found that fixed stops can be employed with the piston portion 76 and central seal 74 offset to produce a different end of travel damping. Thus, for door operators, Applicant has found that an offset of 55% for closing and 45% for opening is an optimum fixed setting.

A needle valve 77 is adjustably mounted by a threaded lock nut 78 in body 60 to selectively locate the tapered end 79 of a needle in the upper side of the passageway 70. The positioning of the needle valve 77 controls the size of the flow restriction through the speed adjusting passageway 70 and thereby provides a first adjustable control on the movement of the power operator 5 and door 1.

The damping passageway 69 is connected in parallel with the speed adjusting passageway 70 and is provided with a similar adjustable needle valve unit 80. The damping passageway 69 is mounted to one side of the tube 49 and thus provides a minimal continuous interconnection between the two coupling passageways 64 and 65 and thus between the solenoid connection 62 and the cylinder connection 61. However, as illustrated, the damping passageway 69 is significantly smaller than any of the other passageways 70 or 68 and does not appreciably effect the overall operation with the metering assembly 51 in operative position illustrated in FIG. 2. The previous operation of the four-way solenoid valve unit 29 in the opening sequence, supplied air through the rear port 26 and holds of the piston 18 at the end of the stroke to lock the piston and door in the illustrated full line position of FIG. 2. This results in the maintaining of the compressed air within the power cylinder 9. When the four-way solenoid valve unit 29 is reversed to reverse the door position, the compressed air trapped in the air cylinder 9 is allowed to escape at a reasonably rapid rate through the relatively large speed adjusting passageway 70 during the initial return movement. This permits creation of a relatively large break away force on the door 1 and the necessary power to accelerate the door, with the acceleration controlled by the setting of the meter speed adjusting passageway needle valve 77. The door 1 is accelerated and movement continues. The coupling bracket 55 moves rearwardly and at a selected point engages the spaced stop 57 on the damping valve rod 56. Further, movement to the left in FIG. 2 results in the positive repositioning of the damping valve piston 52 within the tube 49 and after a predetermined movement, the reduced portion 76 of damping piston 52 moves from alignment with the speed adjusting passageway 70 and effectively seals such passageway. Consequently, the exhaust flow through the speed adjusting passageway 70 is stopped and exhaust air can only pass outwardly through the damping passageway 69 which, as previously noted, is of a significantly smaller size. This significantly increases the restriction on the exhaust flow and creates a back pressure in the cylinder 9 which more strongly opposes the piston movement as established by the supply line pressure to the opposite side of the piston 18 as provided by the connection at the front head of the power cylinder 9. This reduces the speed of the power cylinder as the door approaches the end of its travel and provides a large air volume means to effectively cushion the air cylinder unit and the associated door or other load with an effective deceleration control. The illustrated embodiment of the invention is particularly directed to relatively heavy duty door openers such as encountered in warehouses, regrigeration units and the like, where the damping will occur during approximately 55% of the cylinder stroke during closing and 45% of the cylinder stroke during opening.

Thus, as viewed in FIG. 2, the bracket 54 engages the damping valve rod shoulder 57 at approximately 55% and 45% of the total stroke of the power cylinder unit 7 during the respective operation modes.

The solenoid valve 29 holds the power cylinder 9 in the retracted alternate position until such time as it is again actuated to reverse the connection to the front and rear heads of the cylinder 9. When that occurs the metering valve assembly 51 is connected to provide full pressure to the rear head of the power cylinder 9 via port 61 while the front head metering valve assembly 50 is connected to meter the exhaust flow in precisely the same manner as that just described. Consequently, the power cylinder movement will reverse with a corresponding reversed controlled acceleration and deceleration of the door.

The acceleration and deceleration for opening and closing may thus be controlled independently. For example, it might be desirable to significantly increase the damping characteristic during the closing operation to prevent possible striking of personnel and equipment. During the opening operation, the same degree of damping may not be required if the door moves into a more or less protected area.

The speed adjusting passageway with the metering of the exhaust flow minimizes any tendency for the door opening to occur in an erratic, stepped manner such as often may occur with automatic door openers which encounter a relatively large initial breakaway force due to its weight and/or sealing characteristic of the door, and particularly if the door otherwise has a relatively low friction hardware and support. The power cylinder is powered to positively hold the door in the two alternate positions. When the solenoid valve reverses, the holding air is, in essence, in a more or less compressed condition within the power cylinder 9 except for the exhaust adjustment passageway. If the exhaust condition is rapidly created and prior to the build-up of pressure on the opposite or the operating end of a level sufficient to cause breakaway, the exhaust effectively reduces the retarding pressure on the piston 18. When the driving force then rises to the breakaway level, the retarding force has already dropped significantly and as a result immediately after breakaway, undesired acceleration and high speed travel of the power cylinder unit 7 and door 1 may be created until the damping mode is established. Thus, even the momentary periods between breakaway and the completion of the exhaust passageway results in a significant reduction in the exhaust characteristic and, consequently, in prior unit permits undesired rapid acceleration. When the damping does start the rapidly moving piston has a build-up of pressure on the exhaust side, because the rapid acceleration will tend to trap and compress a greater quantity of air within the cylinder than would normally be provided during the desired controlled exhaust. At some point, prior to the complete open travel, the air to the exhaust side may, therefore, be compressed momentarily to a level which exceeds the driving force on the opposite side of the piston. This may cause a slight hesitation and actual return bounce of the door until the small remaining volume of exhaust air had continued to bleed out of the opening through the severely restricting needle valve. The dual metering adjustment eliminates such a possibility by permitting the operator to accurately adjust the initial speed opening to restrict the exhaust passageway during the initial reversal of the solenoid and to thereby accurately control the door acceleration and speed during the initial travel and prior to the initiation of actual damping. This permits a highly desired control on the build-up or on the air pressure characteristic to initially release it at a controlled rate to permit smooth opening but to maintain a controlled build-up at a proper rate to smoothly start and stop the door. This also minimizes the volume just prior to when the door closes and thereby minimize the amount of decayed fluid after stopping.

Thus, the damping valve of the present invention may be readily applied with any power cylinder unit and provides a relatively simple and therefore relatively inexpensive, practical device or external control.

Although the two metering assemblies 50 and 51 are shown as an integrated unit, separate assemblies can be provided with an appropriate adjustable coupling between separate valve piston or with separate coupling to the power cylinder to provide complete adjustable mounting or the like.

The complete independent multiple adjustment provided by the unique damping valve unit of the present invention is particularly desirable as a practical matter to adapt the unit to a plurality of different door characteristics. Thus, smoothness, reliability and safety of travel during the entire stroke of the power operator is a function of many different factors including the door weight, the friction characteristics of the door support and guides, the characteristic of the supply pressure as well as the required initial seal or breakaway force required to initiate movement of heavy doors and the like. The unitized mounting design permits convenient construction of different sized power operator. Thus, the same basic assembly may be changed by substituting different power cylinder units. The characteristics within any given design will not only vary for different size doors but, as a practical matter, for any given installation depending upon the particular mounting characteristics and surrounding environment. Consequently, the multiple adjustment provided by the separate damping valve assemblies and with the internal multiple adjustments permits ready optimum setting for any given installation.

The independent forward and reverse drive motion control is also particularly important for industrial door operators where a significant difference in the speed of opening and closing the door is often desirable. Thus, the door should open quickly to provide rapid access and also minimize the potential damage from a rapid moving vehicle. The door should, however, close significantly more slowly to provide a high degree of safety to personnel and property moving through the opening as well as the door apparatus. The closure during the final closing portion from the dangerous pinch point should be particularly at a slow speed. Thus, in combination, the door operator may be set with a very high speed opening and some reasonable final damping to prevent damage to the mechanism. A relatively intermediate speed closing is provided in combination with a high degree of damping through the final closing to the pinch point. This provides a relatively rapid closure without creation of abnormally dangerous conditions.

In summary, during the installation the operator independently adjusts the metering valves during the power opening and closing of the door to adjust the actual characteristic to the desired speed and to the desired damping characteristic by adjustment of the metering orifices. For example, the initial closing portion will normally be a relatively high speed closure to minimize the door opening period. However, the final closure should be at a significantly reduced speed to permit personnel, vehicles and the like to move out of the door closing opening and further to minimize the impact in the event they are in the doorway.

The exact characteristic can be controlled further by relative shaping of the damping piston and cylinder to provide a graduated closing of the speed adjusting passageway rather than the single abrupt on-off characteristic illustrated. For example, if the damping piston is provided with a generally cone-shaped closure portion rather than the abrupt step change, the metering characteristic will be further modified in accordance with the clearance between the piston and the cylinder wall during the speed adjusting cycle.

The controlled speed of acceleration and the controlled acceleration and deceleration over essentially 100% of the total stroke of the operator and particularly the result of the controlled metering of the large volume of exhaust air permits highly accurate control of the speed as well as the final cushioning motion of the cylinder and interconnected door or other load even though such a load may have a relatively large mass.

The four-way solenoid valve unit 29 can, of course, be of any suitable construction and operated through any suitable control, or any other automatically controlled supply means can be provided. The illustrated solenoid valve unit 29 is diagrammatically illustrated in FIG. 2 by the conventional ASA symbol as loaded by a spring 81 to a first position and having a solenoid 82 which establishes the alternate position when energized. The valve unit 29 includes a pair of cylinder ports connected respectively to the assemblies 50 and 51 by line 63 and 63*a* for selectively supplying and exhausting air therethrough. A common supply port or passageway 83 and a pair of exhaust ports or passageways 84 and 84*a* which are selectively coupled to the cylinder port lines 63 and 63*a* through a valve spool, not shown, which is selectively positioned by the de-energization and energization of the solenoid 82.

The illustrated air supply system includes the usual lubricating means 32 and consequently the exhaust air carries some oil content. Although minute, if the exhaust is directly within housing 13, it constitutes a possible source of contamination for the electrical switching components. The valve unit 29 is therefore desirably mounted adjacent to an outer housing wall with the exhaust ports 84 and 84*a* aligned with appropriate openings, as most clearly shown in FIG. 6. In certain applications, the operator may be constructed with a suitable low friction material or coating to avoid the air borne lubrications. However, longer operating life has been found with the use of the lubricant.

In FIG. 2, the assembly is shown as having just moved unit 29 to the de-energized position to close the door. In the energized condition, the valve unit 29 would shift to the alternate position from FIG. 2 tending to extend and hold piston rod 19 to the door open position as shown in FIG. 2. Inlet pressure is then applied to the rear metering assembly 51 and thus the rear head of the cylinder 9 which is closed off from the related exhaust port. The front cylinder head metering assembly 50 is connected to the related exhaust and disconnected from the supply port. Conversely, when the unit is de-energized the valve unit is in the full line position of FIG. 2 and the cylinder head connection exhaust through assembly 51 and supplies air through assembly 50.

The air supply system preferably is provided with a suitable manually operable power release valve unit 85 such that in the event of any malfunction, associated with, for example, a loss of electrical power, the power cylinder 9 can be completely exhausted. This will permit the convenient manual operation of the door and thereby prevent interference with the operation of the system. This, of course, is also essential in connection with certain installations such as a freezer room where the operator must be permitted to provide manual release of the door structure in the event of a failure. The illustrated emergency air released valve unit 85 is a well-known lever actuated three-way, normally open valve coupled directly in series with the connecting line 7*a* to the up-stream side of the solenoid valve unit 29 and having a manual control 85*a* for the convenient operation by the necessary personnel.

For illustrated valve 29, to close the door, the solenoid valve unit 29 is de-energized and to open and hold the door in the open position, the solenoid is energized. A particularly satisfactory system and circuit is illustrated in FIG. 7. Thus, referring to FIG. 7, the solenoid air valve coil 86 is connected to a suitable power source such as the usual alternating current power supply. The solenoid valve unit and circuit is preferably a low voltage system and is coupled to the incoming conventional supply line 87 through a step-down transformer 88, which provide the desired low voltage output. One end of winding 86 is connected to the common of the transformer secondary 89 and the opposite end is selectively connected by a relay unit 90 to the opposite side of the secondary for selective energization in response to momentary actuation of any one of the illustrated control switches 10 and 11 or the reversing safety switch 46 during closing cycle only as shown in FIG. 7 and switch 46*a* when employed. The relay unit 90 is preferably of a ratcheting type having a drive winding 91 connected to the secondary 89 in series parallel with the several control switches 10 and 11. The closure of any one or more of these switches energizes the relay winding which drives a suitable ratchet mechanism to transfer and latch the contacts between alternate door open and door close position. The switches 10, 10*a* and 11 preferably are constructed to provide a direct momentary operation to prevent the accidental continued energization of the ratcheting relay. Thus, the ratcheting relay normally requires de-energization and energization before it will actually step its contacts.

The contacts of the ratcheting relay 90 are shown in a common movable pole or arm 92 connected to the secondary of the transformer 88 and selectively engaged with a door open contact 93 and a door close contact 94. The door open contact 93 is connected to the air valve coil 86 and is energized to effect the opening and holding of the door open. The close door contact 94 normally de-energizes coil 86 to effect closing of the door and holding of the door closed. The close door contact 94 is connected in series with safety switch 46 to energize the relay 90 during the door closure cycle if an abnormal condition results in closing of switch 46.

The switch contact arm 92 moves from the illustrated closed door position to energize the solenoid coil 86 until the relay 91 is again actuated to reset the contacts.

The solenoid air valve unit 29 is energized and connects the cylinder head port 26 to the air supply line 9*a* and connects the front head port 25 to atmosphere via the assemblies 51 and 50, respectively, as shown in FIG. 2. As a result the power cylinder piston 18 and piston rod extend thereby opening the door with a cushioned stopped movement. The power cylinder unit 17 positively holds the door in the open position until such time as personnel actuate a control switch 10, 10*a* or 11 to close the door 1. The latter would reset the ratcheting relay contacts to the full line position shown, de-energizing the solenoid coil 86. The solenoid valve unit 29 would then automatically return to the reset opposite position under the action of spring 81 again providing for the opposite connection of the cylinder ports 25 and 26 through the metering valve assemblies 50 and 51 to supply air to the frost head port 25 and to exhaust air under a controlled manner from port 26, with the resulting power closing of the door, once again with the metered speed adjustment and damping adjustment.

The safety switch 46 is normally open and is normally wired between the power supply and the top side of the ratcheting relay coil 91 in series with the fixed closed door contacts 94 of the ratchet relay. Thus, when the door is in the closing mode, closing of the safety switch 46 again ratchets the relay 90 to practically instantaneously reverse the position of the solenoid unit 29 whereupon the power actuator 7 is oppositely connected to the air supply to stop closing and to again provide door opening movement. If both safety switches 46 and 46*a* are employed, the switches should be parallel connected to any set of terminals which are normally connected to control switches such as switches 10 and 11, or connected one to each of the fixed contacts of the ratcheting relay.

The door 1 may also be provided with additional safety such as a safety edge switch 95 such as commonly employed in elevator doors and other structures. The switch 95 is shown parallel connected with the closing safety switch 46 and thus functions only during the door closing mode. Further, the unitized construction and mounting of the power cylinder, the metering assembly and interrelated controls also adapts the system to widely varying and relative severe environmental conditions. Thus, as shown in FIG. 6, an environmental conditioner such as a heater 96 may be mounted within the housing 13. A low wattage heater particularly if housing 13 is insulated will permit maintaining of a suitable operating temperature. Thus, the system can be readily designed to operate in minimum temperatures of degrees.

Similarly, if a high temperature environment is encountered, a cooling system would be coupled to the unitized construction. Such a system can, of course, be as simple as a relatively cool air supply tube connected to supply cooling air into the housing 13 to maintain a maximum operating temperature for the system which can be readily designed for temperature up to 190 degrees. The arm opening in the housing 13 through which the tubular arm 22 projects may be provided with a flexible type closure or the like to completely enclose the operating components while permitting arm movement for severe conditions.

The present invention provides a reliable and relatively simple power door operator which is readily adapted to the many different types of door constructions and installations. For exmaple, the structure for the horizontal sliding door 2 shown in FIGS. 1 – 7 can be readily applied to a vertical rise door 97, for example, as shown in FIG. 8. Thus, a conventional vertical rise door 97 is mounted for vertical movement in a suitable guide track 98 and 99. A power operator 100 is mounted to one side of the door 97 with the linkage 101 extending laterally across the door 97 and interconnected thereto by the mounting plate unit 102. The unit is built as previously described and the excursion rod and the positioning rod are appropriately located to provde for raising and lowering of the door structure. Thus the dual, pivotal mounting linkage 101 permits the required accurate movement of the drive arm portion while transmitting of the force to the door to thereby provide for powered opening and closing. Once again, the unique damping valve unit 103 provides a controlled acceleration and deceleration of the door movement and provides and maintains accurate control during the complete door movement.

Essentially the same construction for a door operator 104 can be readily applied to a swinging door 105 having a vertical hinge 106, for example, as shown in FIG. 9. For a swinging door, the drive arm 107 of a similar linkage 108 is preferably formed with an outer angled portion to minimize the protrusion of the linkage and to optimize the force transmission. The flexible rod 109 is pivotally coupled to a positioning rod 110 by rigid coupled 111 mounted on the excursion rod 109 and with the positioning rod 110 adjustably secured within a clamping block 112. The outer end of the positioning rod 110 is formed with a right angle pivot portion pivotally attached to a bushing 113 in a mounting plate 114, with the offset pivot permitting the normal movement of the cylinder power unit 104 while transmitting of said motion as a swinging motion to the door 105. Thus it is merely necessary to change the drive arm 107 and the positioning rod 110 in the interconnecting linkage to adapt the complete unit to a swinging door construction.

Further, in many installations, the door must close automatically in the event of fire and may be provided with a closing weight 114 which is shown in FIG. 1 in a particular novel construction for automatic door operators. The weight 114 is connected to cable 115 which passes over a pulley and then extends along to the top of the door 1, passing through an eyelet bolt member 116 secured in the top of the door 1. The outer end of the cable 115 is provided with a loop 117 hooked over a top of a pivoted arm 118 pivotally mounted on the mounting structure. The loop 117 is formed such that when released, the end of the loop end of cable 115 cannot pass through the eyelet member 116 but rather transmits the force of weight 114 to the eyelet bolt member 116 and thereby to the door 1. A fused linkage 119 extends across the top of the door opening 3 beneath the cable 115 with a plurality of fuse links 120 spaced therein. The linkage 119 is connected to hold pivot arm 118 and the attached weight inoperative until a fuse 120 is disrupted by a fire. In accordance with a further aspect of this invention, the operator 5 is effectively removed to permit the automatic closure. Referring particularly to FIGS. 1 and 6, a normally closed valve unit 121 is coupled in series in the air supply line 9*a* to the solenoid valve 29. Valve unit 121 may be similar to unit 85. The linkage 119 is secured to the valve unit 121 to hold the valve 121 open and permits the normal operation. The linkage 119 is looped over an anchor pin 122 on the pivot arm 118, extends back across the door and is secured to the front track bracket. When any one of the fuses 120 is released in response to disruption or breakage of the fuse 120, the linkage releases valve 121 which operatively cuts off the air supply from the operator and exhausts the operator. This also releases the pivot arm 118, which pivots under the tension of the cable 115 and its associated weight 114. In so pivoting, the cable loop 117 slips from the top of the arm and the weight drops pulling the cable along the top until the loop 117 engages the eyelet bolt 116 and transmits the weight to the door. This positively closes the door 1.

Thus, the power operator of the present invention may be conveniently adapted to fire doors and the like. Additionally, interlocks may, of course, be employed. For example, the valve air line connections may be responsive to fire and heat to directly disrupt and exhaust the power operator to provide a redundancy in the air system.

The operator of this invention can also be applied to the conventional sectional overhead door by horizontal mounting and coupling of a special two degree of freedom linkage to the top section of a door for swinging-lifting action thereof. Also the operator can be applied to hinged swinging doors.

Further, the operators can be readily applied to biparting sliding doors or to double swinging doors and the like. An individual operator is provided for each of the doors. One of the door operators is constructed as illustrated in the drawings and thus provided with the necessary electrical control and solenoid air valve unit and functions as a master control unit. The second operator for the other half of the door assembly includes the power cylinder and separate travel damping valves suitably housed within an enclosure and coupled to the door by the appropriate linkage. The second operator does not have a separate electrical control or solenoid valve but rather is connected through suitable connecting fluid lines in dotted illustration with the master operator and functions as the slave unit, as shown for example in FIG. 2. In an actual, practical system, the double door operators will generally be standardized to provide the controls in one unit such as the left hand operation while the opposite unit is always formed as the slave unit, to adapt the unit to mass production processes and the like and to minimize installation requirements and the like. The several doors of double units would be provided with individual safety switches all of which would be parallel connected such that operating any one reverses the door operator and movement.

Further, the door unit may employ an air-piloted four-way air valve in place of the electrically driven system where required, for example, in explosive environments. Suitable air activated controls such as in the fluidic art could be employed for reversing controls and the like.

The relatively simple, rugged external damping valve assembly provides a wide adjustment of drive characteristics in order to meet particular specifications arising from different installations. The same basic operator can, of course, be constructed with a plurality of different diameter cylinders to adjust the system to wide ranges of light and heavy door installations as well as available pressure. Thus, an extremely large door with a great amount of friction may be operated with standard air pressure by merely employing a larger diameter cylinder. All mountings can, of course, be made standard with the shroud or enclosure constructed to accommodate the largest possible diameter and thereby permit introduction of the desired cylinder. The pivotal mounting of the cylinder to the supporting frame and to the rod similarly allows the adaptation of any desired cylinder to the operating mechanism including the support and the linkage.

The integrated construction of the door operator also provides convenient adaptation to a wide variety of door construction and permits its installation to existing or new doors in a relatively simple, inexpensive and reliable manner. The door operator itself is of a relatively simple, reliable, rugged construction which can be factory assembled. A very minimum number of working components are employed and all may be formed of a heavy duty type construction to minimize the possible failure points. Further, pneumatic cylinder units and the necessary control valves and the like are readily available and understood in industry. Consequently, special field personnel is not required for normal servicing of the operator. Further, where a plurality of the operators are employed in any given plant, any repair parts to be inventorized can be minimized as a result of essential interchangeability between the several parts of the various operators.

The present invention thus provides a highly improved pneumatic load positioning device and particularly one adapted to the opening and closing of heavy industrial type doors and the like.

Various modes of carrying out the invention are contemplated as being within the scope of the following claims, particularly pointing out and distinctly claiming the subject matter which is regarded as the invention.

I claim:

1. An automatic fluid activated operating apparatus for controlling a fluid motor means driven from a fluid supply means and a fluid exhaust means and having a pair of operating port means for supplying and exhausting of fluid from the motor means, comprising metering valve means connected to said port means to exhaust fluid from the motor means, said metering valve means including a plurality of passageway means between the port means and the exhaust means, at least a first of said passageway means constituting an acceleration control passageway including a movable closure means for varying the effective size of said first passageway means, said closure means being coupled to the motor means and mounted for progressive selective positioning within said passageway in accordance with the relative position of said motor means and being progressively correspondingly positioned after selected movement of the motor means to change the effective operation of said first passageway means to control the rate of change movement of the output of the motor means, said closure means being selectively coupled to the motor means and moves thereby through a selected portion of the output of the motor means, said closure means being constructed with a plurality of different closure sizes and successively moving into said first passageway means to correspondingly vary the rate of closure of said first acceleration control passageway means at different selected rates with the position of the motor means.

2. The operating apparatus of claim 1 wherein said metering valve means includes a tubular control member having a diametrically extended passageway forming a part of said first passageway means, said closure means includes a closure member relatively slidably disposed within said tubular control member, the internal diameter of said control member and the external diameter of said closure member varying relative to each other to control the closing and opening of said first passageway.

3. The operating apparatus of claim 2 wherein said closure member has a first closure portion and a second offset opening portion to define a step change in the opening and closing of the first passageway means.

4. The operating apparatus of claim 2 wherein said diameters vary in a progressive manner to produce a gradual change in the size of said first passageway means.

5. The operating apparatus of claim 2 wherein said diameters vary in a progressive manner and in a step-like manner to produce gradual and step changes in the effective size of said first passageway means.

6. The automatic fluid activated operating apparatus of claim 5 including a linkage means connecting of the motor means to a door to open and close the door said tubular control member having a second diametrically extended passageway spaced axially from the first passageway, said closure member having spaced closure portions aligned with the first and second passageways, for simultaneous opposite movement relative to said passageways, said closure portions being selected to effectively close the aligned one passageway during the final 55 percent of the door opening or closing stroke.

7. An automatic fluid activated operating apparatus for controlling a fluid motor means driven from a fluid supply means and a fluid exhaust means and having a pair of operating port means for supplying and exhausting of fluid from the motor means, comprising metering valve means connected to said port means to exhaust fluid from the motor means, said metering valve means including a plurality of passageway means between the port means and the exhaust means, at least a first of said passageway means including closure means for varying the effective size of said first passageway means, and said closure means being coupled to the motor means and selectively positioned in accordance with the relative position of said motor means after selected movement of the motor means to change the effective operation of said first passageway means to control the rate of change movement of the output of the motor means, said metering valve means includes a body portion including a first, second and third parallel passageway between a motor connection means and a supply-exhaust connection means, said body portion having mounting means for connection to the motor means, said first passageway means being adjustable and providing a first restricted flow passageway controlled by said closure means, said first passageway means being located between said second and third passageway means and including a cross-opening therethrough, said closure means being a piston-like element mounted in said cross-opening and coupled to the motor means for selectively positioning in accordance with the relative position of said motor means, the third of said passageways constituting a one-way flow passageway means permitting full transfer of fluid pressure from the supply-exhaust connection means to the motor connection means and restricting reverse flow, and the second of said passageways providing a continuous restricted flow passageway.

8. The operating apparatus of claim 2 wherein said second passageway means includes an adjustable means, said second passageway means having a minimum restriction significantly greater than the minimum restriction of said first passageway means whereby the second passageway means provides maximum damping characteristics after closure of the first passageway means.

9. The operating apparatus of claim 1 for coupling to a door of a building, comprising a pivoting door arm pivotally mounted and coupled to said fluid motor means for selective pivoting between a door open position and a door closed position, a connecting linkage connected to said pivoting door arm and including a first adjustable link connected as a linear extension to said door arm and a pivot joint coupler connected to a second adjustable link and to said first adjustable link, means to adjust the relative lengths of said second adjustable link, and a door attachment means pivotally attached to said second adjustable link and including a mounting means for selectively coupling of said second adjustable link to the door for moving of the door.

10. The operating apparatus of claim 9 wherein said pivoting door arm includes an outer offset portion and said door attachment means includes a pivot axis parallel to the axis of the pivoting door arm for attachment to a swinging door.

11. The operating apparatus of claim 9 wherein said pivoting door arm is rectilinear and said first link is a rod adjustably attached to the outer end of the arm, said second link being a rod, said pivot point coupler being pivotally secured to one of said rods and adjustably attached to the other of said rods.

12. In the automatic fluid activated operating apparatus of claim 1 wherein said fluid motor means is a reversible cylinder operator having a cylinder with a pair of opposite end ports for selectively supplying and exhausting of fluid with respect thereto for reversibly driving a piston having an output rod, said metering valve means including a pair of individual metering valve assemblies connected respectively to each of said ports and each having a common supply-exhaust connection means and a port connection means joined by said plurality of passageways, and control valve means for selectively connecting said common supply-exhaust connection means of said pair of valve assemblies to supply and exhaust fluid from said cylinder.

13. An automatic fluid activated operating apparatus for controlling a cylinder operator having a cylinder with a pair of end ports for selectively supplying and exhausting of fluid from the said ports for reversibly driving a piston having an output rod, a pair of individual metering valve assemblies connected respectively to each of said ports and each having a common supply-exhaust connection means and a port connection means, each of said metering valve assemblies including a plurality of passageway means between the port connection means and the supply-exhaust connection means, at least a first of said passageway means including closure means for varying the effective size of said first passageway means, and said closure means being coupled to the motor means and selectively positioned in accordance with the relative position of said motor means after selected movement of the motor means to change the effective operation of said first passageway means to control the rate of change movement of the output of the motor means, control valve means for selectively connecting said common supply-exhaust connection means of said pair of valve assemblies to supply and exhaust fluid from said cylinder, each of said metering valve assemblies includes a body portion including a first, second and third parallel passageway between the motor connection means and the supply-exhaust connection means, the first of said passageways constituting a one-way flow passageway means permitting full transfer of fluid pressure from the supply-exhaust connection means to the port connection and restricting reverse flow from the cylinder, said second passageway means being adjustable and providing a first restricted flow passageway between the metering connections, said second passageway means including means for positively closing said passageway, and said closure means being coupled to the motor means and selectively positioned in accordance with the relative position of said motor means, and said third passageway means including an adjustable means to define a restricted passageway between the metering valve assembly connections, said third passageway means having a restriction significantly greater than restriction of said second passageway means whereby the third passageway means provides maximum damping characteristics through movement of the fluid motor and automatic means for selectively controlling the connection of the supply means and the exhaust means to said metering valve means.

14. In the operating apparatus constructed in accordance with claim 8 including a pivoting load drive arm pivotally mounted and coupled to said cylinder piston rod for selective pivoting between a first load position and a second load position, a connecting linkage connected to said pivoting drive arm and including a first adjustable link connected to said drive arm, a second adjustable link pivotally connected to said first adjustable link, and a load attachment means pivotally attached to said second adjustable link and including mounting members for selectively coupling of said second adjustable link to the load for preselected linear and swinging movement of the load.

15. An automatic fluid activated operating apparatus for controlling a cylinder operator having a cylinder with a pair of end ports for selectively supplying and exhausting of fluid from the said ports for reversibly driving a piston having an output rod, a pair of individual metering valve assemblies connected respectively to each of said ports and each having a common supply-exhaust connection means and a port connection means, each of said metering valve assemblies including a plurality of passageway means between the port connection means and the supply-exhaust connection means, at least a first of said passageway means including closure means for varying the effective size of said first passageway means, and said closure means being coupled to the motor means and selectively positioned in accordance with the relative position of said motor means after selected movement of the motor means to change the effective operation of said first passageway means to control the rate of change movement of the output of the motor means, control valve means for selectively connecting said common supply-exhaust connection means of said pair of valve assemblies to supply and exhaust fluid from said cylinder, an enclosure, means mounting said cylinder, said control valve means and metering valve assemblies within said enclosure, and means within said enclosure to control the operating temperature within the enclosure.

16. The automatic fluid activated operating apparatus of claim 15 including a housing for said motor means and said metering valve assembly, said supply means including an air source having means to introduce lubricating oil into the air supplied to the motor means, an electrically actuated control valve mounted within said housing for reversing the connection of the metering assembly to the supply and the exhaust means, an electrical control for said control valve mounted within said housing, and passageway means for directing said exhaust from said control valve directly from said housing.

17. An automatic pneumatic door controller comprising a reversible pneumatic cylinder unit having opposite end ports for selectively supplying and exhausting of air to correspondingly position a piston and piston rod, the relative connection of the supply and of the exhaust connections to said ports determining the direction of the piston, a pair of individual metering valve assemblies connected respectively to each of said ports and each having a common supply-exhaust connection means, means for selectively connecting said common supply connection means to a supply means and to an exhaust means, each of said metering valve assemblies including a body portion including a first, second and third parallel passageway between the port connection means and the supply-exhaust connection means, the first of said passageways constituting a one-way flow passageway means permitting full transfer of air pressure from the supply connection means to the port connection means and preventing reverse flow from the cylinder, said second passageway means being adjustable and providing a first restricted flow passageway between the metering connections, said second passageway means including means for positively closing said passageway, said closure means being coupled to the motor means and selectively positioned in accordance with the relative position of said motor means, said third passageway means including an adjustable means to define a restricted passageway, said third passageway means having a minimum restriction significantly smaller that the minimum restriction of said second passageway means whereby the third passageway means provided maximum damping characteristics, an automatic means for selectively controlling the connection of the supply means and the exhaust means to said metering valve means.

18. The door operator of claim 17 wherein said metering valve assemblies include a common tube member mounted on top of said cylinder and passing through said second passageways, said closure means includes a common metering piston slidably mounted within said tube and having a pair of spaced reduced diameter portions spaced in accordance with said second passageways, and means coupling of said common metering piston to said piston rod.

19. The door operator constructed of claim 18 including a pivoting door-arm operator pivotally mounted and coupled to said fluid motor drive for selective pivoting between a door open position and a door closed position, a connecting linkage connected to said pivoting door operator and including a first adjustable link connected to said door operator and a second adjustable link pivotally connected to said first adjustable link, and a door attachment means pivotally attached to said second adjustable link and including a plurality of mounting members for selectively coupling of said second rod adjustable link to the door for linear movement of the door and alternatively for a swinging movement of the door.

20. In the automatic pneumatic door operator of claim 17 including a safety valve means connected in said supply means, a mechanical means connected to the safety valve means to hold the valve means to supply air to the motor means, a mechanical door closure means coupled to the door, and a fused linkage means coupled to said mechanical door closure means and said mechanical latch means to exhaust said motor means and release said closure means.

* * * * *

UNITED STATES PATENT AND TRADEMARK OFFICE

CERTIFICATE OF CORRECTION

PATENT NO. : 3,936,977
DATED : February 10, 1976
INVENTOR(S) : ARTHUR J. RUNFT ET AL It is certified that error appears in the above-identified patent and that said Letters Patent are hereby corrected as shown below:

| | | | | |
|---|---|---|---|---|
| ABSTRACT | | Line | 2, | after "valve" insert --- unit ---; |
| Column | 6, | Line | 4, | before "larger" cancel "somethat" and insert --- somewhat ---; |
| | | Line | 36, | before "end" cancel "oppsoite" and insert --- opposite ---; |
| Column | 11, | Line | 34, | after "warehouses" cancel "regrigera-" and insert --- refrigera- ---; |
| Column | 16, | Line | 62, | after "rigid" cancel "coupled" and insert --- coupler ---; |
| Column CLAIM 6 | 19, | Line | 62, | before "passageway" cancel "one"; |
| Column CLAIM 8 | 20, | Line | 32, | after "claim" cancel "2" and insert --- 7 ---; |
| Column | 21, | Line | 42, | after "passageway" cancel "means"; |
| | | Line | 44 | before "means" insert --- forming the passageway ---; and after "including" insert --- said closure ---; |
| | | Line | 45, | before "passageway" insert --- second ---; and after "passageway," cancel "and said"; |

UNITED STATES PATENT AND TRADEMARK OFFICE

CERTIFICATE OF CORRECTION

PATENT NO. : 3,936,977

DATED : February 10, 1976

INVENTOR(S) : ARTHUR J. RUNFT ET AL

It is certified that error appears in the above-identified patent and that said Letters Patent are hereby corrected as shown below:

| | | | |
|---|---|---|---|
| Column 21, CLAIM 13 | Line | 46, | cancel the entire line; |
| | Line | 47, | cancel the entire line; |
| | Line | 48, | cancel "position of said motor means"; |
| | Line | 49, | after "way" cancel "means" (first occurrence); |
| | Line | 50, | after "passageway" insert --- means ---; |
| | Line | 51, | after "passageway" cancel "means"; |
| | Line | 53, | after "passageway" cancel "means"; |
| | Line | 54, | after "sageway" cancel "means"; |
| | Line | 58, | after "valve" cancel "means" and insert --- assemblies ---; |
| Column 23, CLAIM 17 | Line | 4, | after "smaller" cancel "that" and insert --- than ---; |

Signed and Sealed this

Fourteenth Day of September 1976

[SEAL]

*Attest:*

RUTH C. MASON
*Attesting Officer*

C. MARSHALL DANN
*Commissioner of Patents and Trademarks*